US007997005B2

(12) United States Patent
Monk et al.

(10) Patent No.: US 7,997,005 B2
(45) Date of Patent: Aug. 16, 2011

(54) ANTENNA AND BLOWER SYSTEM TO REMOVE PRECIPITATION FROM THE ANTENNA

(75) Inventors: Anthony D. Monk, Seattle, WA (US); Michael de La Chapelle, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 160 days.

(21) Appl. No.: 12/251,668

(22) Filed: Oct. 15, 2008

(65) Prior Publication Data

US 2010/0088924 A1 Apr. 15, 2010

(51) Int. Cl.
*F26B 21/00* (2006.01)

(52) U.S. Cl. ..... 34/380; 34/443; 34/523

(58) Field of Classification Search ..... 34/380, 34/412, 443, 523
See application file for complete search history.

(56) References Cited

U.S. PATENT DOCUMENTS 2,556,710 A * 6/1951 Stalker ..... 416/20 R
3,572,131 A * 3/1971 Wright ..... 73/866
3,855,591 A * 12/1974 Young ..... 342/33
5,690,050 A * 11/1997 Doi ..... 118/723 MP

FOREIGN PATENT DOCUMENTS

DE 10053395 A1 * 9/2001

* cited by examiner

*Primary Examiner* — Jiping Lu
(74) *Attorney, Agent, or Firm* — Charles L. Moore; Moore & Van Allen PLLC

(57) ABSTRACT

A blower system to remove precipitation from an antenna may include a blower air plenum extending substantially completely along one side of the antenna. A vent is in communication with the blower air plenum and extends substantially completely along the one side of the antenna to direct an airstream across a surface of the antenna to remove precipitation from the antenna. The vent may include a contour to conform to a contour of the one side of the antenna. The blower system may also include an air compressor to force air into the blower air plenum and out the vent to form the airstream flowing across the surface of the antenna.

19 Claims, 4 Drawing Sheets

ANTENNA AND BLOWER SYSTEM TO REMOVE PRECIPITATION FROM THE ANTENNA

FIELD

The present invention relates to antennas, antenna arrays and the like, and more particularly to a blower system to remove precipitation from an antenna, such as a phased array antenna or other type of antenna.

BACKGROUND OF THE INVENTION

Planar phased array antennas, such as those used for satellite communications on airborne platforms are generally mounted in a horizontal plane at the crown or upper most portion of an aircraft's fuselage. This location can provide a substantially maximum spatial coverage of the phased array antenna. However, when the aircraft is on the ground, precipitation, such as rain water or other precipitation can accumulate on a surface of the phased array antenna aperture in this configuration. The accumulation of water or other precipitation can significantly impair satellite link performance and in some cases the link may be dropped entirely. Phased array antennas with some curvature in one or both planes may also experience some accumulation of water which can impair performance.

BRIEF SUMMARY OF THE INVENTION

In accordance with an embodiment of the present invention, a blower system to remove precipitation from an antenna, such as a phased array antenna or similar antenna, may include a blower air plenum extending substantially completely along one side of the antenna. A vent may be in communication with the blower air plenum and may extend substantially completely along the one side of the antenna to direct an airstream across a surface of the antenna to remove precipitation from the antenna. The vent may include a contour to conform to a contour of the one side of the antenna. The blower system may also include an air compressor to force air into the blower air plenum and out the vent to form the airstream across the surface of the antenna.

In accordance with another embodiment of the present invention, a blower system to remove precipitation from an antenna mounted on an aircraft may include a blower air plenum extending substantially completely along one side of the antenna. A vent may be in communication with the blower air plenum and may extend substantially completely along the one side of the antenna to direct an airstream across a surface of the antenna to blow precipitation from the antenna. The vent may have a contour to conform to a contour of the one side of the antenna. The blower system may also include a heating device to heat air forming the airstream being directed across the surface of the antenna to cause evaporation of the precipitation. The blower system may additionally include an air compressor to force air through the heating device, through the blower air plenum and out the vent to form the airstream flowing across the surface of the antenna.

In accordance with another embodiment of the present invention, a blower system to remove precipitation from an antenna mounted on an aircraft may include a first blower air plenum extending substantially completely along one side of the antenna. The blower system may also include a first vent in communication with the first blower air plenum. The first vent may extend substantially completely along the one side of the antenna to direct a first airstream in one direction across a surface of the antenna to remove precipitation from the antenna. The first vent may also have a contour conforming to a contour of the one side of the antenna. The blower system may also include a second blower air plenum extending substantially completely along an opposite side of the antenna from the one side. The blower system may also include a second vent in communication with the second blower air plenum. The second vent may extend substantially completely along the opposite side of the antenna to direct a second airstream across the surface of the antenna in an opposite direction to the one direction of the first airstream to remove precipitation from the antenna. The second vent may also have a contour conforming to a contour of the opposite side of the antenna. The blower system may also include a heating device for heating air to be used in forming the first and second airstreams to cause evaporation of the precipitation. The blower system may further include an air compressor to force air through the heating device to heat the air, though the first and second blower air plenums and out the first and second vents to respectively form the first and second airstreams flowing across the antenna.

In accordance with another embodiment of the present invention, a blower system to remove precipitation from an antenna may include a blower air plenum. The blower system may also include a vent in communication with the blower plenum to direct an airstream in one direction across a surface of the antenna to remove precipitation from the antenna. The vent may include a length that corresponds to a maximum dimension of the antenna perpendicular to the one direction of flow of the airstream. The blower system may also include an air compressor to force air into the blower plenum and out the vent to form the airstream across the surface of the antenna.

In accordance with another embodiment of the present invention, a method to remove precipitation from an antenna may include forcing an airstream across a surface of the antenna to remove precipitation from the antenna. The airstream may be forced from a vent including a length that corresponds to a maximum dimension of the antenna perpendicular to a direction of flow of the airstream. The method may also include heating air used to form the airstream to cause evaporation of the precipitation.

Other aspects and features of the present invention, as defined solely by the claims, will become apparent to those ordinarily skilled in the art upon review of the following non-limited detailed description of the invention in conjunction with the accompanying figures.

BRIEF DESCRIPTION OF THE SEVERAL VIEWS OF THE DRAWINGS

The following detailed description of embodiments refers to the accompanying drawings, which illustrate specific embodiments of the invention. Other embodiments having different structures and operations do not depart from the scope of the present invention.

DETAILED DESCRIPTION OF THE INVENTION

The following detailed description of embodiments refers to the accompanying drawings, which illustrate specific embodiments of the invention. Other embodiments having different structures and operations do not depart from the scope of the present invention.

Figure 1:
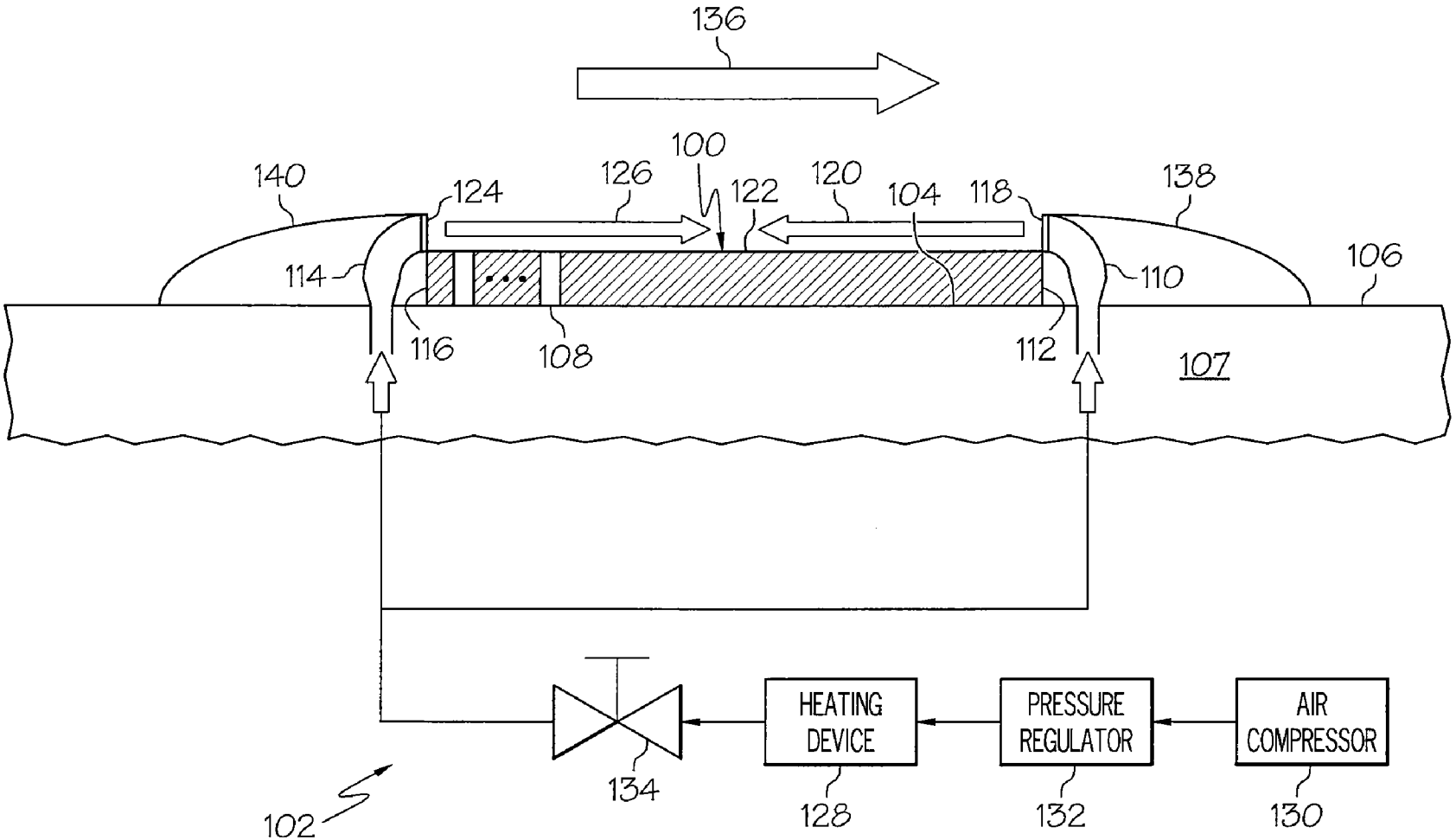
FIG. 1 is a cross-sectional side elevation view of a phased array antenna and a blower system to remove precipitation from the phased array antenna in accordance with an aspect of the present invention.

FIG. 1 is a cross-sectional side elevation view of a phased array antenna 100 and a blower system 102 to remove precipitation from the phased array antenna 100 in accordance with an aspect of the present invention. While the phased array antenna 100 in FIG. 1 and in the other drawings may be illustrated as being substantially planar and the embodiments of the present invention may be described with reference to planar phased array antennas, the embodiments of the present invention are also applicable to other types of antennas including those that may not be planar but may have some curvature in one of both planes.

The phased array antenna 100 may be mounted in a crown 104 or top portion of an aircraft fuselage 106. The antenna 100 may be mounted in a fairing 138 and 140 which is mounted in turn on the crown 104 of the aircraft fuselage 106. As described in more detail herein, a first blower air plenum 110 and a first vent 118 may be integrally formed in the fairing 138 on one side of the antenna 100, and a second blower air plenum 114 and a second vent 124 may be integrally formed in another fairing 140 on an opposite side of the antenna 100. In another embodiment of the present invention, the antenna 100 may be directly mounted conformally in the skin of the aircraft 107. While the embodiments of the present invention may be described herein as being applicable to aircraft, the blower system 102 and antenna 100 may also be mounted in other types of vehicles or stationary objects and the present invention is not necessarily limited to applications on aircraft.

The phased array antenna 100 may be used for satellite communications or other communications. The phased array antenna 100 may be substantially rectangular in shape similar to the phased array antenna 200 illustrated in FIG. 2, although other configurations may also be used and the blower system configurations described herein may be adapted accordingly.

The phased array antenna 100 may include a plurality of radiating elements 108 or apertures that may be arranged in a uniform or predetermined array to provide a selected radiation pattern from the combined radiating elements 108. The array of radiating elements 108 may also be feed or energized in a phased relationship to provide selected radiation patterns or to send and receive signals from selected directions. As previously discussed the performance of the planar phased array antenna 100 may be adversely affected by rain water or other forms of precipitation accumulating on the array antenna 100. The different embodiments of the blower system 102 described herein may be used to remove precipitation or rain water for the array antenna 100 and improve performance.

Figure 2:
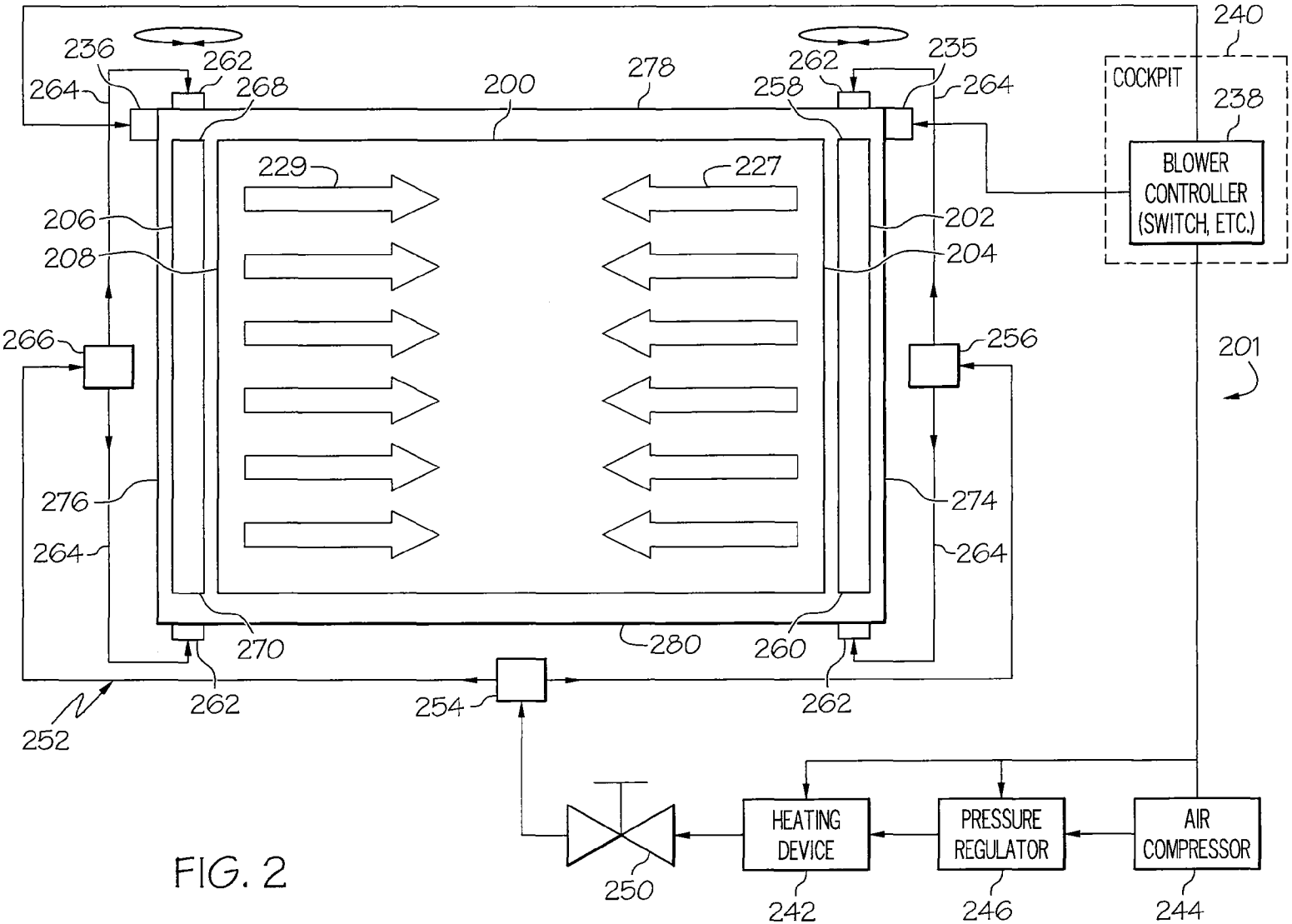
FIG. 2 is a schematic diagram of an example of a phased array antenna and blower system to remove precipitation from the phased array antenna in accordance with another aspect of the present invention.

The blower system 102 may include a first blower air plenum 110. The first blower air plenum may extend along one side 112 of the antenna 100. The blower system 102 may also include a second blower air plenum 114. The second blower air plenum may extend along an opposite side 116 of the antenna 102 from the one side 112. Referring briefly to FIG. 2, FIG. 2 illustrates a first blower air plenum or first blower cylinder 202 extending substantially completely along one side 204 of the phased array antenna 200 and a second blower air plenum or second blower cylinder 206 extending substantially completely along an opposite side 208 of the phased array antenna 200. While the second blower air plenum 114 is shown in FIG. 1 as extending along the opposite side 116 of the antenna 100, in another embodiment of the present invention, the second blower air plenum 114 could extend along another side of the antenna 100 rather than the opposite side 116. In a further embodiment of the present invention, only a single blower air plenum or blower cylinder, such as air plenum 110 in FIG. 1 or blower cylinder 202 in FIG. 2, may be provided along one side of the antenna 100 or 200.

Referring back to FIG. 1, a first vent 118 is in communication with the first blower air plenum 110. The first vent 118 may extend substantially completely along the one side 112 of the antenna 100. Thus, the first vent 118 defines an opening to the first plenum 110 and may extend substantially the length of the first blower air plenum 110 to direct a first airstream as illustrated by arrow 120 from the first blower air plenum 110 in one direction across a surface 122 of the antenna 100 to remove precipitation, such as rain water or other precipitation from the surface 122 or aperture of the antenna 100. In another embodiment of the present invention, for example where the antenna 100 may have a configuration other than a substantially square or rectangular array, the first vent 118 may have a length that corresponds to a maximum dimension of the antenna perpendicular to a direction of flow of an airstream from the first vent 118 across the antenna 100.

The first vent 118 may have a contour or shape that conforms to a contour or shape of the one side 112 of the antenna 100. For example, if the antenna 100 is a planar phased array antenna, the first vent 118 may be a linear vent with an elongated substantially rectangular shaped opening to direct a linear airstream across the surface 122 of the antenna 100. If the one side 112 of the antenna 100 has some curvature, for example to follow the curvature of the aircraft 107 or other vehicle to which the antenna 100 may be mounted, or has some other contour, the first vent 118 may also be curved or contoured to follow or conform to the curvature or contour of the one side 112 of the antenna 100. Thus, the first vent 118 may extend adjacent to the one side 112 of the antenna 100 in parallel with the one side 112 or following the contour of the one side 112 of the antenna 100.

A second vent 124 is in communication with the second blower air plenum 114 and may extend substantially completely along the opposite side 116 of the antenna 100. Similar to the first vent 118, the second vent 124 defines an opening from the second blower air plenum 114 to direct a second airstream as illustrated by arrow 126 from the second blower air plenum 114 in an opposite direction to the one direction of the first airstream 120 across the surface 122 of the antenna 100 to remove precipitation, such as rain water or other precipitation from the surface 122 or aperture of the planar array 100. The second vent 124 may have a contour or shape that conforms to the contour or shape of the opposite side 116 of the antenna 100. For example, if the antenna 100 is a planar phased array antenna, similar to that illustrated in the drawings, the second vent 124 may be a linear vent with an elongated substantially rectangular shaped opening to direct a linear airstream across the surface 122 of the antenna 100. If the opposite side 116 of the antenna 100 is curved or has some other contour, the second vent 124 may have a corresponding contour to follow or match the opposite side 116. The second vent 124 may also have a length that corresponds to a maximum dimension of the antenna perpendicular to the direction of flow of the airstream 126 if the antenna 100 has a different configuration than a square or rectangular shape similar to that illustrated in the drawings.

The blower system 102 may include a heating device 128 to heat the air to be used in forming the first and second airstreams 120 and 126 which are directed across the surface 122 of the antenna 100 from the first and second vents 118 and 124, respectively, to cause evaporation of the precipitation. The air may be heated to a temperature between about 50 degrees and about 100 degrees Celsius. The air may also be heated to any temperature that will not damage the array antenna 100 or components of the blower system 100.

The blower system 102 may also include an air compressor 130 to force the air through the heating device 128 to force the air through the heating device 128, through the first and second blower air plenums 110 and 114 and out the first and second vents 118 and 124 to respectively form the first and second airstreams 120 and 126 flowing across the surface 122 of the antenna 100. A pressure regulator 132 may be used to regulate the velocity of air from the air compressor 128 that is blown across the surface 122 of the antenna 100. A control valve 134 may also be provided to control the flow or air from the heating device 128 to the first and second plenums 110 and 114.

The first and second blower air plenums 110 and 114 may extend transverse to a direction of flight of the aircraft 107 or transverse to a longitudinal extend of the aircraft fuselage 106 as illustrated by arrow 136. In other words, the direction of airflow or the airstreams 120 and 126 may be parallel to the direction of flight of the aircraft or parallel to the longitudinal extent of the aircraft fuselage 106 as illustrated by arrow 136. A first fairing 138 may be disposed adjacent to the first blower air plenum 110 or may enclose the first blower air plenum 110. Similarly, a second fairing 140 may be disposed adjacent to the second blower air plenum 114 or may enclose the blower air plenum 114. In accordance with an embodiment of the present invention, the fairings 138 and 140 may each be formed with the respective first and second blower air plenums 110 and 114 and vents 118 and 124 being integrally formed therein. As shown in FIG. 1, each of the vents 118 and 124 from the respective blower air plenums 110 and 114 have their respective openings just above the sides 112 and 116 of the array antenna 100 which is shown in FIG. 1 as being mounted on a surface of the aircraft fuselage 106. The array antenna 100 could also be recessed in the aircraft fuselage 106 or directly mounted conformally in the skin of the aircraft 107 with the openings of the vents 118 and 124 being above the sides 112 and 116 of the array antenna 100 to direct air across the surface 122 of the array antenna 100.

In another embodiment of the present invention, the first and second blower air plenums 110 and 114 may extend parallel to the direction of flight of the aircraft 107 or parallel to a longitudinal extend of the aircraft fuselage 106. In this configuration, the airstreams 120 and 126 would be transverse or perpendicular to the longitudinal extend or the aircraft fuselage 106 or perpendicular to the arrow 136 or direction of flight of the aircraft 107.

Figure 3:
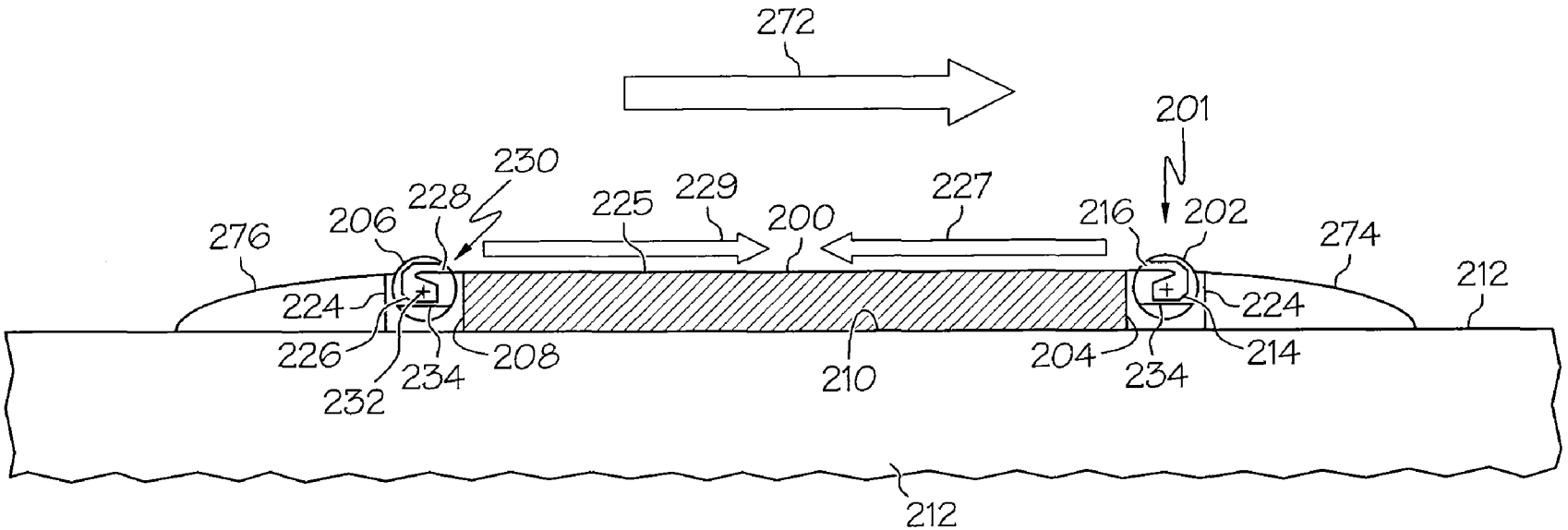
FIG. 3 is a cross-sectional side elevation view of a phased array antenna and first and second blower cylinders of the blower system of FIG. 2 in accordance with an aspect of the present invention.
Figure 4A:
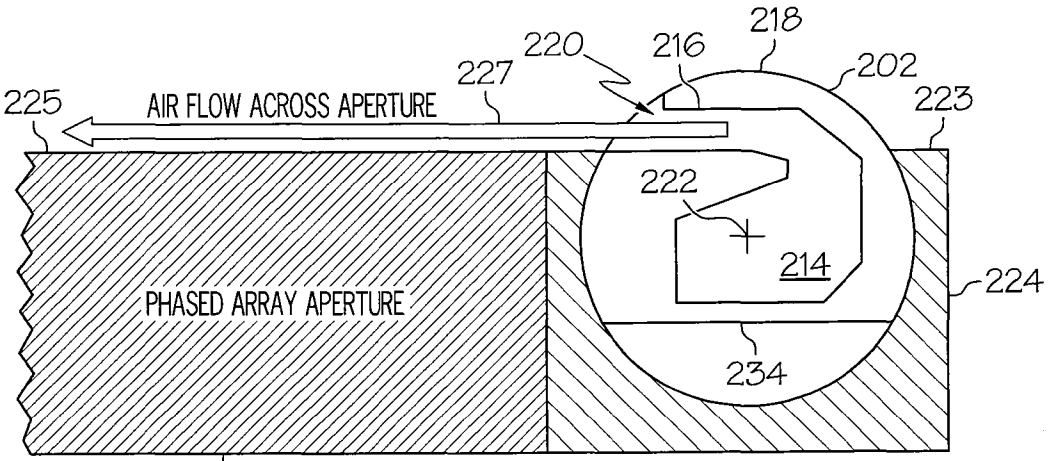
FIG. 4A is a detailed cross-sectional side elevation view of one of the blower cylinders of FIG. 3 in a deployed position to remove precipitation from the phased array antenna in accordance with an aspect of the present invention.
Figure 4B:
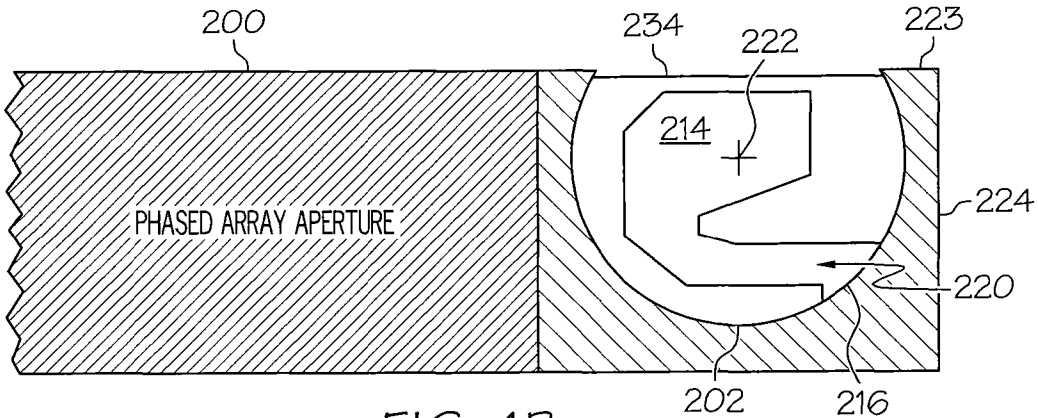
FIG. 4B is a detailed cross-sectional side elevation view of one of the blower cylinders of FIG. 3 in a retracted position or flight configuration in accordance with an aspect of the present invention.

FIG. 2 is a schematic diagram of an example of a phased array antenna 200 and blower system 201 to remove precipitation from the phased array antenna 200 in accordance with another aspect of the present invention. As illustrated in FIG. 2, the antenna 200 may be substantially rectangular although other configurations could be used as well. The blower system 201 may include a first blower cylinder 202 and a second blower cylinder 206. The first blower cylinder 202 may extend substantially completely along one side 204 of the antenna 200 and the second blower cylinder 206 may extend substantially completely along an opposite side 208 of the antenna 200 from the one side 204. Referring also to FIGS. 3, 4A and 4B, FIG. 3 is a cross-sectional view of the phased array antenna 200 and first and second blower cylinders 202 and 206 of the blower system 201 of FIG. 2. The antenna 200 and the first and second blower cylinders 202 and 206 are shown mounted to a crown 210 or upper portion of an aircraft 212 in FIG. 3 although the antenna 200 and blower system 201 may also be used on other vehicles or stationary objects. FIG. 4A is a detailed view of the first blower cylinder 202 of FIG. 3 in a deployed position to remove precipitation from the antenna 200 in accordance with an aspect of the present invention. FIG. 4B illustrates the first blower cylinder 202 of FIG. 3 in a retracted position or flight configuration.

A first blower air plenum 214 and a first vent 216 may be formed in the first blower cylinder 202. The first vent 216 may extend from the first blower air plenum 214 through an exterior surface 218 of the first blower cylinder 202. The first vent 216 may form a longitudinal opening 220 along the first blower cylinder 202 parallel to a longitudinal axis 222 of the first blower cylinder 202. The first blower cylinder 202 is rotatable in a first support structure 224 between a deployed position as illustrated in FIG. 4A and a retracted position as illustrated in FIG. 4B. In the deployed position in FIG. 4A, the first vent 216 is positioned to direct an airstream across the surface 225 of the antenna 200 as illustrated by arrow 227 in FIG. 4A. In the retracted position in FIG. 4B the longitudinal opening 220 of the first vent 216 is rotated into the first support structure 224 to close the first vent 216 and the first blower air plenum 214.

The second blower cylinder 206 may have a similar structure to the first blower cylinder 202. A second blower air plenum 226 and a second vent 228 may be formed in the second blower cylinder 206 as illustrated in FIG. 3. The second vent 228 may extend from the second blower air plenum 226 through an exterior surface of the second blower cylinder 206 to form a longitudinal opening 230 along the second blower cylinder 206 parallel to a longitudinal axis 232 of the second blower cylinder 206. Referring to FIGS. 2 and 3, the first and second vents 216 and 228 (FIG. 3) may extend substantially completely along the respective sides 204 and 208 of the antenna 200 to direct the first and second streams of air 227 and 229 in opposite directions toward one another to remove precipitation from the array antenna 200 while the aircraft is operating on the ground.

The first blower cylinder 202 and the second blower cylinder 206 may each include a flattened exterior portion 234 as best shown in FIGS. 4A and 4B illustrating first blower cylinder 202. The flattened exterior portion 234 provides a planar surface across the entire phased array antenna 200 and blower structure when each of the first and second blower cylinders 202 and 206 are rotated to the retracted position as illustrated in FIG. 4B. The flattened exterior portion 234 is substantially flush with an upper surface 223 of the support structure 224 when the blower cylinder 202 is rotated to the retracted position. In the retracted position the flattened exterior portion 234 substantially eliminates drag and other undesirable aerodynamic effects and also reduces the radar cross section of the antenna and blower assembly.

Referring back to FIG. 2 the blower system 201 may also include a first actuator 235 coupled to the first blower cylinder 202 to rotate the first blower cylinder 202 between the deployed and retracted positions. A second actuator 236 may be coupled to the second blower cylinder 206 to rotate the second blower cylinder 206 between the deployed and retracted positions. A blower controller 238 may be located in the cockpit 240 for a pilot to control operation of the blower system 201. The first and second actuators 235 and 236 may any sort of actuator, such as an electromechanical actuator or device, a pneumatically operated actuator, a hydraulically operated actuator or other mechanical arrangement capable of rotating the blower cylinders 202 and 206 between the deployed and retracted positions.

The blower system 201 may also include a heating device 242 to heat the air to be used to form the first and second airstreams 227 and 229. Accordingly the first and second airstreams 227 and 229 directed across the surface 225 of the antenna 200 respectively from the first and second vents 216 and 228 have heated air to cause evaporation of the precipitation, such as rain water or other precipitation. The airstreams 227 and 229 may include air heated to a temperature between about 50 degrees Celsius and about 100 degrees Celsius.

The blower system 201 may also include an air compressor to force air through the heating device 242, through the first and second blower plenums 214 and 226 and the first and second vents 216 and 228. A pressure regulator 246 may regulate air from the air compressor 244 to control a velocity of air blown across the surface 225 of the antenna 200. The heating device 242, air compressor 244 and pressure regulator may be controlled from the cockpit 240 by the blower controller 238.

The blower system 201 may also include a control valve 248 to control the supply of air from the heating device 242 to the first and second plenums 214 and 226 or first and second blower cylinders 202 and 206. The air may be supplied to the first and second cylinders 202 and 206 by a network 252 of air hoses or ducts. A first junction 254 or T-piece may split or divide the air between the first and second blower cylinders 202 and 206. A second junction 256 or T-piece may split or divide the air for insertion at opposite ends 258 and 260 of the first blower cylinder 202. A bearing and air hose inlet 262 connects a feed air hose 264 to each end 258 and 260 of the first blower cylinder 202.

Similarly, a third junction or T-piece 266 splits or divides the air for insertion at opposite ends 268 and 270 of the second cylinder 206. A bearing and air hose inlet 262 connects a feed air hose 264 to each end 268 and 270 of the second blower cylinder 206. The bearing and air hose inlets 262 allow the first and second cylinders 202 and 206 to rotate to move the vents 216 and 228 between the deployed and retracted positions while maintaining the connection between the feed air hoses 264 and the air plenums 214 and 226.

The first and second blower cylinders 202 and 206 may be mounted to extend transverse to a direction of flight of the aircraft 212 as illustrated in by the arrow 272 in FIG. 3 or transverse to the longitudinal extent of the fuselage of the aircraft. A first fairing 274 may be disposed or mounted to the aircraft 212 adjacent the first blower cylinder 202 or support structure 224 for the first blower cylinder 202 to reduce drag of the blower system 201 and the antenna 200 when the aircraft 212 is in flight. A second fairing 276 may be disposed or mounted to the aircraft 212 adjacent the second blower cylinder 206 or support structure for the second blower cylinder 206. Another set of fairing 278 and 280 (FIG. 2) may be mounted on each side of the antenna 200 and may extend between the first and second fairings 274 and 276.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. Antenna and blower system to remove precipitation from the antenna, comprising:

an antenna on an exterior of a structure and exposed to precipitation;

a blower air plenum extending substantially completely along one side of the antenna;

a vent in communication with the blower air plenum and extending substantially completely along the one side of the antenna to direct an airstream across a surface of the antenna to remove precipitation from the antenna, wherein the vent includes a contour to conform to a contour of the one side of the antenna;

a blower cylinder, wherein the blower air plenum and the vent are formed in the blower cylinder, the vent extending from the blower air plenum through an exterior surface of the blower cylinder and forming a longitudinal opening along the blower cylinder and wherein the blower cylinder is rotatable in a support structure between a deployed position were the vent is positioned to direct air across the surface of the antenna and a retracted position were the opening of the vent is rotated into the support structure to close the vent and the blower air plenum; and an air compressor to force air into the blower air plenum and out the vent to form the airstream across the surface of the antenna.

2. The antenna and blower system of claim 1, further comprising:

another blower air plenum extending substantially completely along another side of the antenna; and another vent in communication with the other blower air plenum and extending substantially completely along the other side of the antenna to direct air across the surface of the antenna to remove precipitation from the antenna, wherein the other vent includes a contour to conform to a contour of the other side of the antenna.

3. The antenna and blower system of claim 2, wherein the other side of the antenna is an opposite side of the antenna from the one side.

4. The antenna and blower system of claim 1, further comprising a heating device to heat the air directed across the surface of the antenna to cause evaporation of the precipitation.

5. The antenna and blower system of claim 4, where the air is heated to a temperature between about 50 degrees and about 100 degrees Celsius.

6. The antenna and blower system of claim 1, further comprising a pressure regulator to regulate a velocity of the air blown across the surface of the antenna.

7. The antenna and blower system of claim 1, wherein the antenna is mounted on an aircraft, the blower system further comprising a fairing disposed about the blower air plenum to substantially eliminate any drag caused by the blower system and antenna when the aircraft is in flight.

8. The antenna and blower system of claim 1, wherein the vent is moveable between the retracted position during flight of an aircraft and the deployed position when the aircraft is on the ground to remove precipitation from the antenna.

9. The antenna and blower system of claim 1, further comprising an actuator coupled to the blower cylinder to rotate the blower cylinder between the deployed and retracted positions.

10. Antenna and blower system to remove precipitation from the antenna mounted on an aircraft, comprising:

an antenna mounted on an exterior portion of the aircraft and exposed to precipitation;

a blower air plenum extending substantially completely along one side of the antenna;

a vent in communication with the blower air plenum and extending substantially completely along the one side of the antenna to direct an airstream across a surface of the antenna to blow precipitation from the antenna, wherein the vent includes a contour to conform to a contour of the one side of the antenna;

a blower cylinder, wherein the blower air plenum and the vent are formed in the blower cylinder, the vent extending from the blower air plenum through an exterior surface of the blower cylinder and forming a longitudinal opening along the blower cylinder and wherein the blower cylinder is rotatable in a support structure between a deployed position were the vent is positioned to direct air across the surface of the antenna and a retracted position were the opening of the vent is rotated into the support structure to close the vent and the blower air plenum;

a heating device to heat air forming the airstream being directed across the surface of the antenna to cause evaporation of the precipitation; and an air compressor to force air through the heating device, through the blower air plenum and out the vent to form the airstream flowing across the surface of the antenna.

11. The antenna and blower system of claim 10, wherein the vent is moveable between the retracted position during flight of the aircraft and the deployed position when the aircraft is on the ground to remove precipitation from the antenna.

12. The antenna and blower system of claim 10, further comprising:

another blower air plenum extending substantially completely along another side of the antenna; and another vent in communication with the other blower air plenum and extending substantially completely along the other side of the antenna to direct air across the surface of the antenna, wherein the other vent has a contour conforming to a contour of the other side of the antenna.

13. The antenna and blower system of claim 12, wherein the other side of the antenna is an opposite side of the antenna from the one side.

14. The antenna and blower system to remove precipitation from the antenna mounted on an aircraft, comprising:

a phased array aperture antenna mounted on an exterior portion of the aircraft and exposed to precipitation;

a first blower air plenum extending substantially completely along one side of the antenna;

a first vent in communication with the first blower air plenum and extending substantially completely along the one side of the antenna to direct a first airstream in one direction across a surface of the antenna to remove precipitation from the antenna, wherein the first vent has a contour conforming to a contour of the one side of the antenna;

a first blower cylinder, wherein the first blower air plenum and the first vent are formed in the first blower cylinder, the first vent extending from the first blower air plenum through an exterior surface of the first blower cylinder and forming a longitudinal opening along the first blower cylinder parallel to a longitudinal axis of the first blower cylinder, and wherein the first blower cylinder is rotatable in a first support structure between a deployed position were the first vent is positioned to direct air across the surface of the antenna and a retracted position were the opening of the first vent is rotated into the first support structure to close the first vent and the first blower air plenum;

a second blower air plenum extending substantially completely along an opposite side of the antenna from the one side;

a second vent in communication with the second blower air plenum and extending substantially completely along the opposite side of the antenna to direct a second airstream across a surface of the antenna in an opposite direction to the one direction to remove precipitation from the antenna, wherein the second vent has a contour conforming to a contour of the opposite side of the antenna;

a second blower cylinder, wherein the second blower air plenum and the second vent are formed in the second blower cylinder, the second vent extending from the second blower air plenum through an exterior surface of the second blower cylinder and forming a longitudinal opening along the second blower cylinder parallel to a longitudinal axis of the second blower cylinder, and wherein the second blower cylinder is rotatable in a second support structure between a deployed position were the second vent is positioned to direct air across the surface of the antenna and a retracted position were the opening of the second vent is rotated into the second support structure to close the second vent and the second blower air plenum;

a heating device to heat air to be used in forming the first and second airstreams to cause evaporation of the precipitation; and an air compressor to force the air through the heating device, though the first and second blower air plenums and out the first and second vents to respectively form the first and second airstreams flowing across the antenna.

15. The antenna and blower system of claim 14, wherein the first vent and the second vent are each movable between the retracted position during flight of the aircraft and the deployed position when the aircraft is on the ground to remove precipitation from the antenna.

16. The antenna and blower system of claim 14, further comprising:

a first actuator coupled to the first blower cylinder to rotate the first blower cylinder between the deployed and retracted positions; and a second actuator mechanically coupled to the second blower cylinder to rotate the second blower cylinder between the deployed and retracted positions.

17. The antenna and blower system of claim 14, wherein the first blower cylinder and the second blower cylinder each comprises a flattened exterior portion to provide a planar surface when each of the first and second blower cylinders are rotated to the retracted position.

18. The antenna and blower system of claim 14, wherein the first and second blower cylinders extend transverse to a direction of flight of the aircraft, the blower system further comprising:

a first fairing disposed adjacent to the first blower cylinder or support structure for the first blower cylinder to reduce drag of the blower system and the antenna when the aircraft is in flight; and a second fairing disposed adjacent to the second blower cylinder or support structure for the second blower cylinder.

19. The antenna and blower system of claim 18, further comprising another fairing mounted on each side of the antenna and extending between the first and second fairings.

* * * * *